US010004958B2

(12) United States Patent
Tang et al.

(10) Patent No.: US 10,004,958 B2
(45) **Date of Patent: *Jun. 26, 2018**

(54) GOLF CLUB HEAD WITH CENTER OF GRAVITY ADJUSTABILITY

(71) Applicant: Callaway Golf Company, Carlsbad, CA (US)

(72) Inventors: Larry Tang, Carlsbad, CA (US); James A. Seluga, Carlsbad, CA (US); D. Clayton Evans, San Marcos, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days. days.

This patent is subject to a terminal disclaimer.

(21) Appl. No.: 15/592,951

(22) Filed: May 11, 2017

(65) Prior Publication Data

US 2017/0246518 A1 Aug. 31, 2017

Related U.S. Application Data

(60) Division of application No. 15/057,830, filed on Mar. 1, 2016, now Pat. No. 9,682,299, which is a division of application No. 14/446,185, filed on Jul. 29, 2014, now Pat. No. 9,308,423, which is a continuation-in-part of application No. 14/039,102, filed on Sep. 27, 2013, now Pat. No. 8,834,294, which (Continued)

(51) Int. Cl.
*A63B 53/06* (2015.01)
*A63B 53/04* (2015.01)

(52) U.S. Cl.
CPC ..... *A63B 53/06* (2013.01); *A63B 53/0466* (2013.01); *A63B 2053/0416* (2013.01); *A63B 2053/0433* (2013.01); *A63B 2053/0491* (2013.01)

(58) Field of Classification Search
CPC ..... A63B 53/06; A63B 53/0466; A63B 2053/0416; A63B 2053/0433; A63B 2053/0491
See application file for complete search history.

(56) References Cited

U.S. PATENT DOCUMENTS 6,672,975 B1 * 1/2004 Galloway ..... A63B 53/04 473/342
6,988,960 B2 * 1/2006 Mahaffey ..... A63B 53/0466 473/345

(Continued)

*Primary Examiner* — Stephen Blau
(74) *Attorney, Agent, or Firm* — Rebecca Hanovice; Michael Catania; Sonia Lari

(57) ABSTRACT

The present invention is directed to a golf club head comprising one or more center of gravity and bias adjustment features. In some embodiments, the golf club head comprises an elongated cartridge having one or more sockets or weight ports to receive weight plugs, the arrangement of which can be changed to adjust the mass properties of the golf club head. The orientation of the cartridge itself can also be reversed to adjust the mass properties. In other embodiments, the golf club head comprises at least one semicircular weight ring that extends around the rear portion of the golf club head, and is removable and replaceable to adjust the mass properties of the golf club head. In still other embodiments, these features are combined on one head.

8 Claims, 11 Drawing Sheets

Related U.S. Application Data is a continuation of application No. 13/797,404, filed on Mar. 12, 2013, now abandoned.

(60) Provisional application No. 61/938,629, filed on Feb. 11, 2014, provisional application No. 61/684,079, filed on Aug. 16, 2012, provisional application No. 61/665,203, filed on Jun. 27, 2012, provisional application No. 61/657,247, filed on Jun. 8, 2012.

(56) References Cited

U.S. PATENT DOCUMENTS

| | | | | |
|---|---|---|---|---|
| 7,404,772 | B2 * | 7/2008 | Koide | A63B 53/007 473/334 |
| 7,601,076 | B2 * | 10/2009 | Rollinson | A63B 53/0487 473/249 |
| 7,878,919 | B2 * | 2/2011 | Perry | A63B 53/04 473/288 |
| 8,162,776 | B2 * | 4/2012 | Boyd | A63B 53/0466 473/334 |
| 8,506,421 | B2 * | 8/2013 | Stites | A63B 53/0466 473/335 |
| 8,657,702 | B2 * | 2/2014 | Boyd | A63B 53/0466 473/334 |
| 8,876,623 | B2 * | 11/2014 | Boyd | A63B 53/04 473/288 |
| 2003/0232659 | A1 * | 12/2003 | Mahaffey | A63B 53/0466 473/256 |
| 2007/0293333 | A1 * | 12/2007 | Gwon | A63B 53/0466 473/228 |
| 2009/0270199 | A1 * | 10/2009 | Chen | A63B 53/0466 473/348 |

* cited by examiner

GOLF CLUB HEAD WITH CENTER OF GRAVITY ADJUSTABILITY

CROSS REFERENCES TO RELATED APPLICATIONS

The present application is a division of U.S. patent application Ser. No. 15/057,830, filed on Mar. 1, 2016, which is a division of U.S. patent application Ser. No. 14/446,185, filed on Jul. 29, 2014, which claims priority to U.S. Provisional Patent Application No. 61/938,629, filed on Feb. 11, 2014, and is also a continuation-in-part of U.S. patent application Ser. No. 14/039,102, filed on Sep. 27, 2013, which is a continuation of U.S. patent application Ser. No. 13/797,404, filed on Mar. 12, 2013, which claims priority to U.S. Provisional Patent Application No. 61/657,247, filed on Jun. 8, 2012, U.S. Provisional Patent Application No. 61/665,203 filed on Jun. 27, 2012, and U.S. Provisional Patent Application No. 61/684,079 filed on Aug. 16, 2012, the disclosure of each of which is hereby incorporated by reference in its entirety herein.

STATEMENT REGARDING FEDERALLY SPONSORED RESEARCH OR DEVELOPMENT

Not Applicable

BACKGROUND OF THE INVENTION

Field of the Invention

The present invention relates to a golf club head comprising a center of gravity height adjustability assembly.

Description of the Related Art

The prior art discloses various designs with center of gravity adjustments to improve golf club performance.

The prior art fails to provide a golf club with designs that efficiently alter center of gravity parameters and consequentially enable the golf club to be swung faster along its path and contribute to an improved impact event with the golf ball.

The United States Golf Association (USGA) has increasingly limited the performance innovations of golf clubs, particularly drivers. Recently, the USGA has limited the volume, dimensions of the head, such as length, width, and height, face compliance, inertia of driver heads and overall club length. Current methods previously used to improve the performance of a driver have been curtailed by limitations on design parameters set by the USGA. An area of driver performance improvement that exists, as of this date, is the potential to adjust the height of the center of gravity. A change in height of the center of gravity would allow the driver club head to travel faster along its path and contribute to an improved impact event with the golf ball, resulting in higher golf ball velocities and consequentially, in longer golf shots.

The purpose of this invention is to effectively incorporate several design features in the golf club head that will enable adjustment of the height of the center of gravity.

The recent past has shown that driver designs have trended to include characteristics to increase the driver's inertia values to help off-center hits go farther and straighter. Driver designs have also recently included larger faces, which may help the driver deliver better feeling shots as well as shots that have higher ball speeds if hit away from the face center. However, these recent trends may also be detrimental to the driver's performance due to the head speed reductions that these design features introduce due to the larger geometries. The design of the present invention allows for higher inertias and robust face design of current drivers in addition to a golf club head design wherein the center of gravity is adjustable.

BRIEF SUMMARY OF THE INVENTION

The main objective of the present invention is to improve the location of the height of the center of gravity. To improve the height of the center of gravity, a golf club head is created which has center of gravity height adjustment assembly. This multiple designs enabling adjustment of the center of gravity can affect the moment of inertia and ultimately the forgiveness of the golf club head. Another object of the present invention is an adjustable weighting feature for vertical center of gravity control which is placed to maximize effectiveness and may be entirely concealed from view at address.

One aspect of the present invention is a golf club head comprising a body comprising a face, crown, sole, interior cavity, an edge portion where the crown makes contact with the sole, and rear portion opposite the face, a hollow tube extending through the interior cavity to connect the crown with the sole, an elongated cartridge sized to fit within the tube, the cartridge comprising a plurality of side openings, and at least one weight plug sized to fit within at least one of the plurality of side openings, wherein the tube is accessible via an opening in the sole, wherein changing the orientation of the cartridge within the tube changes the location of the golf club head's center of gravity along a vertical Z axis, and wherein placing the at least one weight plug within at least one of the plurality of side openings changes the location of the golf club head's center of gravity along at least one of the vertical Z axis, a horizontal Y axis that extends perpendicular with the vertical Z axis and parallel with the face, or a horizontal X axis that extends perpendicular to the face.

In some embodiments, each of the side openings may be cylindrical, and the at least one weight plug may be sized to fit within the cylindrical side openings. In other embodiments, each of the side openings and the at least one weight plug may be disc shaped. In one embodiment, the cartridge may be removably secured within the hollow tube with at least one fastener. In another embodiment, the cartridge may comprise a protrusion, and the hollow tube may comprise a notch sized to receive the protrusion. In yet another embodiment, the cartridge may be at least partially cylindrical and have one flattened side. In another embodiment, the cartridge may be composed of a transparent or translucent material, and the at least one weight plug may be visible through the cartridge when it is fully engaged within at least one of the plurality of side openings. In some embodiments, the hollow tube may be integrally formed with the sole, while in others the hollow tube may be integrally formed with the crown from a composite material. In some embodiments, the golf club head may further comprise at least one, semicircular weight ring, which may be removably affixed to the edge portion with at least one fastener. In a further embodiment, the weight ring may extend from a heel side of the face to a toe side of the face via the rear portion, and in another embodiment, the weight ring may removably fix the cartridge to the golf club head.

Another aspect of the present invention is a golf club head comprising a metal face component, a composite body comprising a crown, a sole, an interior cavity, and a rear portion opposite the face, a cartridge cap comprising a plurality of openings, and at least one weight plug, wherein the rear portion comprises an opening in communication with the interior cavity, wherein the cartridge cap is sized to fit over the rear portion such that an upper portion of the cartridge cap contacts the crown, a lower portion of the cartridge cap contacts the sole, and a middle portion of the cartridge cap is disposed within the opening, and wherein reversing the orientation of the cartridge on the rear portion changes the location of the golf club head's center of gravity along a vertical Z axis. In a further embodiment, the golf club head may comprise at least one semicircular weight ring, wherein the weight ring extends from a heel side of the face component to a toe side of the weight component via the rear portion, and wherein the weight ring is removably affixed to the body with at least one fastener. In another embodiment, the at least one weight ring may fix the cartridge cap to the body. In yet another embodiment, the cartridge cap may integrally formed with the at least one weight ring.

Another aspect of the present invention is a golf club head comprising a face component, a body comprising a crown, a sole, an interior cavity, an edge portion where the crown makes contact with the sole, and a rear portion opposite the face component, and at least one semicircular weight ring, wherein the weight ring extends from a heel side of the face component to a toe side of the weight component along the edge portion, wherein the weight ring is removably affixed to the face component with at least one fastener, and wherein the at least one semicircular weight ring affects the bias of the golf club head when it is affixed to the golf club head. In a further embodiment, the golf club head may comprise a weight insert, the weight ring may comprise at least one pocket sized to receive the weight insert, and the pocket may face the body when the weight ring is affixed to the golf club head. In a further embodiment, the at least one pocket may comprise a transparent or translucent window, such that the weight insert is visible to a user when it is engaged with the pocket. In another embodiment, the face component may be a face cup.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
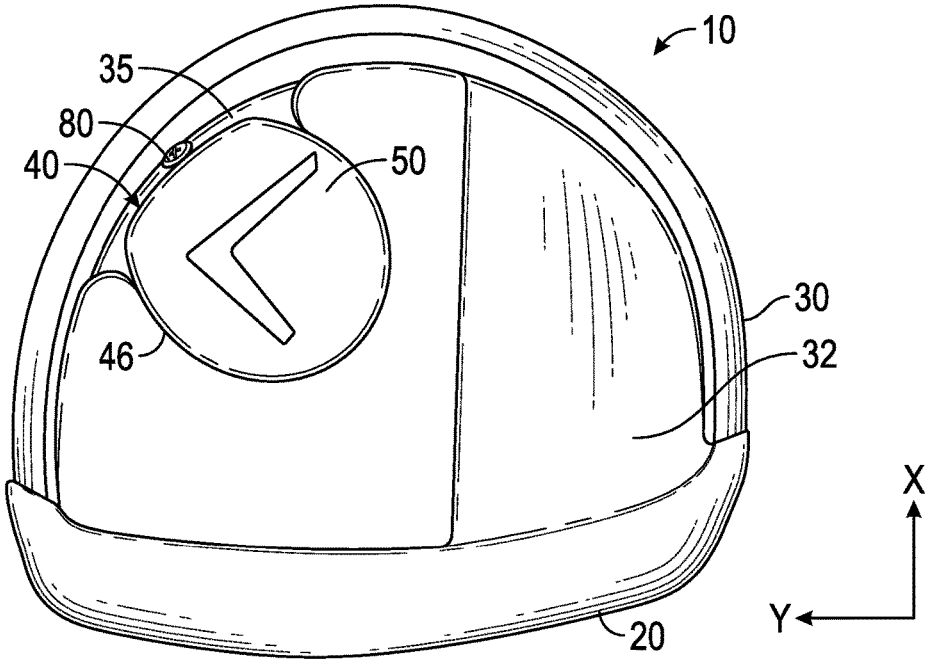
FIG. 1 is a top plan view of a first embodiment of a golf club head according to the present invention.

The present invention relates to the design of a golf club head with at least one tubular center of gravity height adjustment assembly and additional weighting elements. The center of gravity height adjustment assembly preferably is positioned within the hollow interior of the golf club head body. The design approach described here is based on a golf club head construction characterized by a composite crown adhesively bonded to a cast titanium body. However, the center of gravity adjustment assemblies disclosed herein may be used with other constructions including all titanium, all composite, and a composite body with metal face cup. The center of gravity adjustment assemblies disclosed herein are intended to work in conjunction with at least one adjustable weight port on one or more parts (e.g., crown, sole, ribbon) of the golf club head.

A first embodiment of the golf club head according to the present invention is shown in FIGS. 1-4. In this embodiment, the golf club head 10 comprises a face component 20, a body 30 having a sole 32 and a crown 34, a center of gravity height adjustment assembly 40 comprising a tube 45 and an elongated, weighted cartridge 50, and an adjustable hosel assembly 60. The tube 45 is formed integrally with the sole 32 from a material such as metal alloy (such as titanium alloy) or composite, and extends through an interior cavity of the body 30 to connect the sole 32 with the crown 34. An opening 46 in the sole 32 provides access to the tube 45, and, if the cartridge 50 is not engaged with the tube 45, the opening 46 is closed with a cover 70, the exterior surface of which can be customized to be aesthetically pleasing to a golfer.

Figure 4:
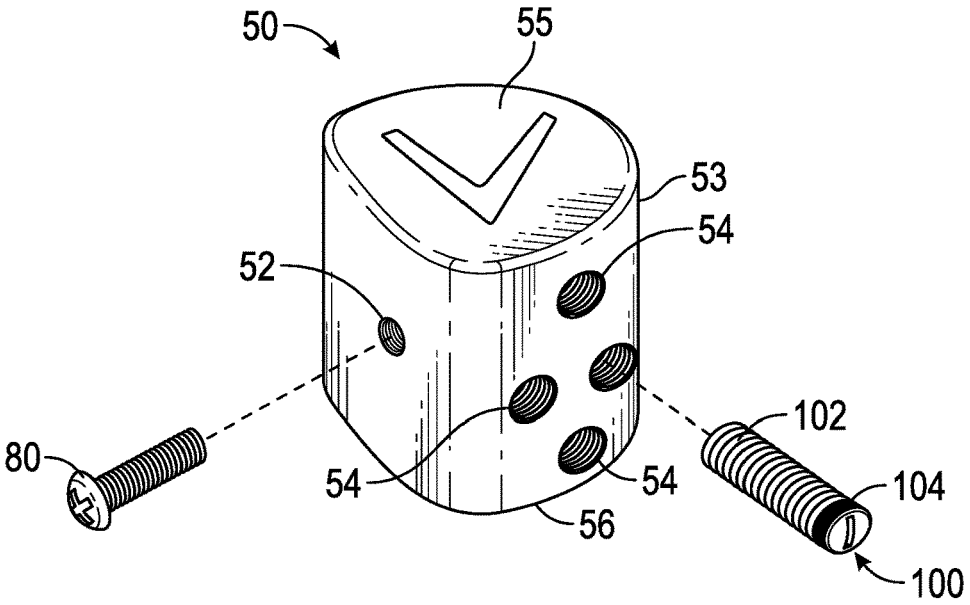
FIG. 4 is a side perspective view of the cartridge shown in FIG. 2 in combination with a weight plug and a fastener.

The cartridge 50, shown in FIG. 4, has an elongated, partially cylindrical structure with one flatter side 51 that follows the contours of the edge portion 35 of the body 30, where the sole 32 meets the crown 34, or, in an alternative embodiment, the ribbon or side wall (not shown) of the body 30. The flatter side 51 includes at least one threaded bore 52 sized to receive a screw fastener 80, while the cylindrical wall 53 comprises a plurality of cylindrical bores 54 that extend at least halfway through the width of the cartridge 50 and that are sized to receive one or more removable, cylindrical weight plugs 100. The weight plugs 100 preferably are at least partially formed from tungsten or other high density materials, and at least one of the weight plugs has one lightweight end 102 and one heavy end 104 and can be removed from the bores 54 and inverted to allow for adjustments to both golf club head 10 bias and center of gravity location. The weight plugs 100 may be color coded or otherwise marked to indicate their weight configurations. The weight plugs 100 preferably do not require any mechanisms to retain them in the bores 54, such that simply inserting the cartridge 50 into the tube 42 prevents the weight plugs from dislodging from the bores 54, but in alternative embodiments, the weight plugs 100 may be retained within the bores 54 with threads, such that the bores 54 include threads that mate with threads on the weight plugs 100, and/or via friction fit, semi-permanent adhesives, or other means known to a person skilled in the art.

The cartridge 50, which preferably comprises a heavy end and a lightweight end created through the use of multiple materials, may be removed from the tube 45, inverted, and reinserted into the tube 45 to further affect the location of the golf club head's 10 center of gravity, and preferably has upper and lower surfaces 55, 56 with patterned and/or textured features that are aesthetically pleasing to a golfer and/or provide information about the orientation of the cartridge 50 within the tube 45. The cartridge 50 is at least partially composed of a translucent or transparent material so that the weight plugs 100 are visible when they are fully engaged with the bores 54.

Figure 2:
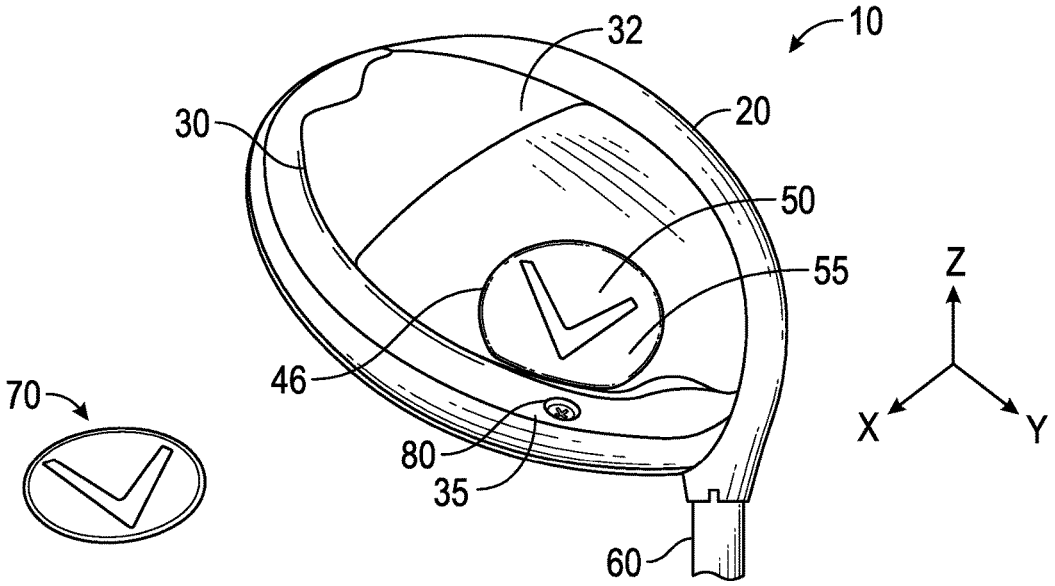
FIG. 2 is a rear perspective view of the embodiment shown in FIG. 1.
Figure 3:
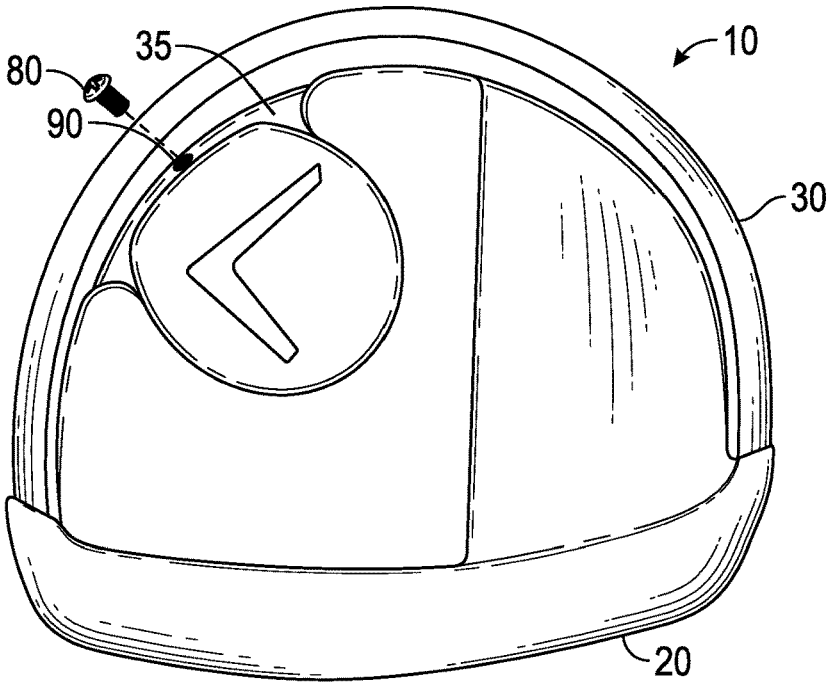
FIG. 3 is a top plan view of the embodiment shown in FIG. 1 with its fastener removed.

The cartridge 50, when fully engaged with the tube 45, abuts an inner surface of the crown 34 and also fills both the tube 45 and the opening 46 and makes use of the cover 70 unnecessary. As shown in FIGS. 1-3, the tube 45 is disposed at a rear side of the sole 32, and the cartridge 50 is fixed within the tube 45, and thus to the golf club head 10, with at least one screw fastener 80 that is inserted into at least one threaded bore 90 disposed in an edge portion 35 where the sole 32 meets the crown 34 or, in an alternative embodiment, in a ribbon or side wall (not shown) proximate the tube 45. The threaded bore 90 in the edge portion 35 lines up with the threaded bore 52 in the cartridge 50, and the screw fastener 80 reversibly fixes the cartridge within the tube 45.

Figure 5:
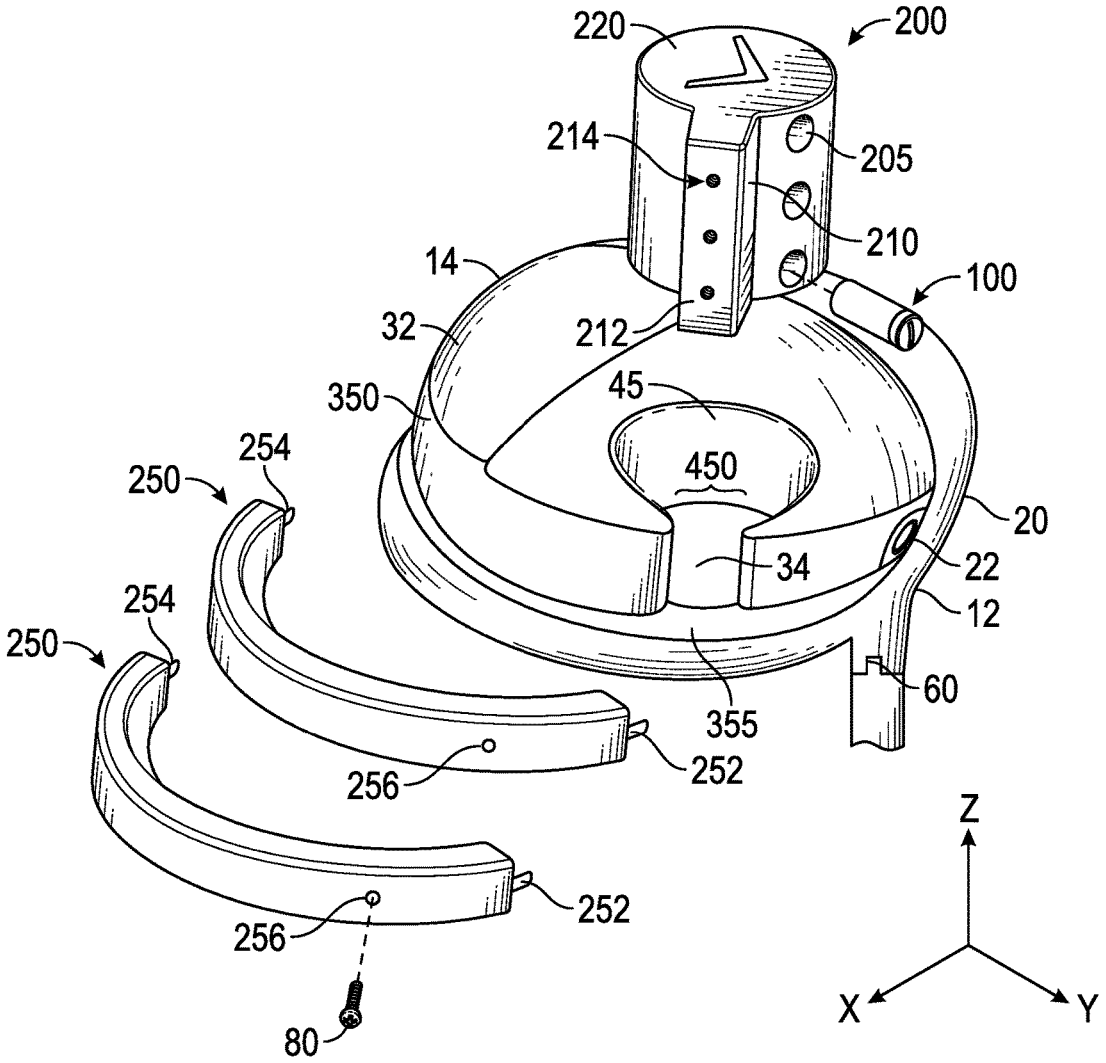
FIG. 5 is an exploded view of a second embodiment of a golf club head according to the present invention in combination with the cartridge shown in FIG. 6.
Figure 6:
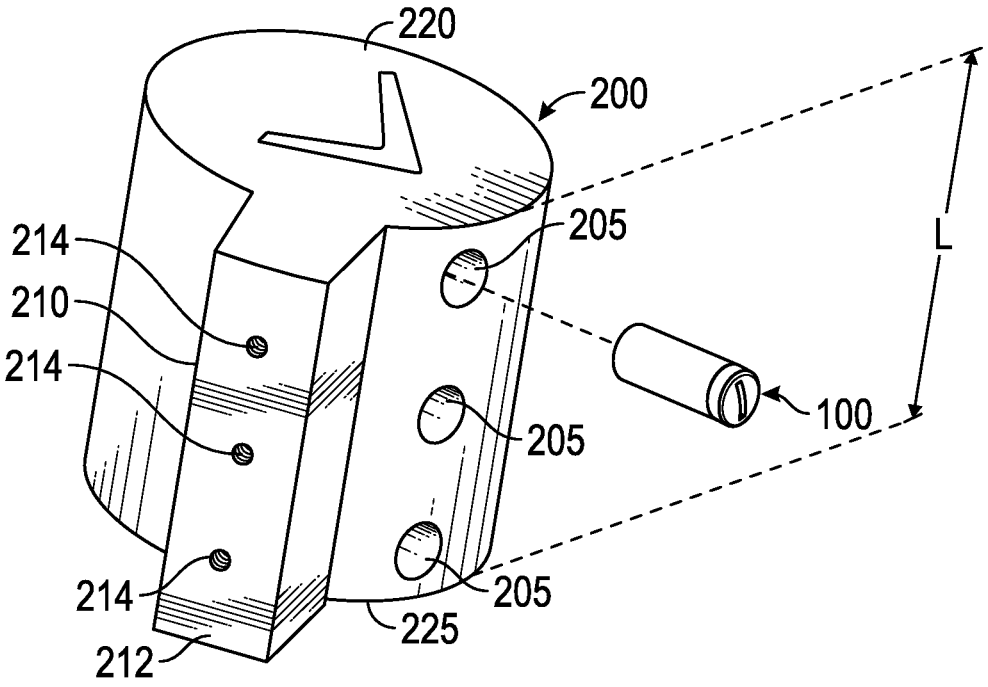
FIG. 6 is a side perspective view of a second embodiment of a cartridge in combination with a weight plug.

A second, preferred embodiment of the golf club head of the present invention is shown in FIGS. 5-6. In this embodiment, the golf club head 10 has many of the same features as the first embodiment, but instead of an edge portion 35, the golf club head 10 includes a ribbon 350 and the tube 45 includes a notch 450 that extends from the sole 32, continues along the ribbon 350, and ends at the crown 34. The ribbon 350 is slightly offset from the crown 34, such that a ledge 355 is formed between the ribbon 350 and the crown 34. The tube 45 dead ends at the inner surface of the crown 34, which may form the lower surface of the tube 45. In this embodiment, the body 30 preferably is composed of composite material and the face component 20 is a metal alloy face cup, preferably composed of a titanium alloy.

The cartridge 200 that fits within this structure is shown in FIG. 6, and has a cylindrical structure with an elongated protrusion 210 extending along at least half of its length L sized to fit within and fill the notch 450 extending from one edge. The elongated protrusion 210 comprises an outermost edge 212 with a plurality of threaded bores 214 sized to receive one or more screw fasteners 80. Like the cartridge shown in FIG. 4, this second cartridge comprises a plurality of bores 205 sized to receive one or more weight plugs 100, upper and lower surfaces 220, 225 with patterned and/or textured features that are aesthetically pleasing to a golfer and/or provide information about the orientation of the cartridge 200 within the tube 45, and is at least partially composed of a translucent or transparent material so that the weight plugs 100 are visible when they are fully engaged with the bores 205. This cartridge 200 can also be inverted to affect the golf club head's 10 center of gravity location. The weight plugs 100 used with this cartridge 200 preferably have the same composition and structure as disclosed in connection with the embodiment shown in FIG. 4.

Figure 8:
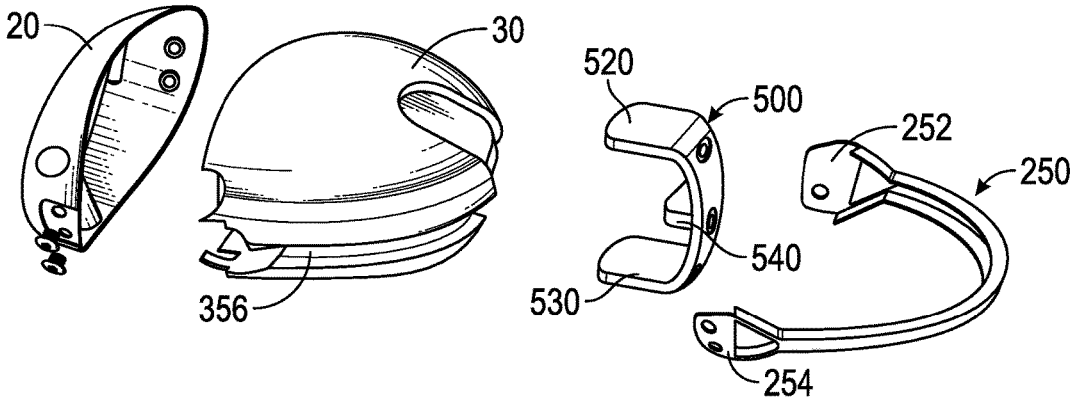
FIG. 8 is side, exploded view of the third embodiment shown in FIG. 7.

The preferred embodiment also includes at least one semicircular weight ring 250, which is removably affixed to the golf club head 10 proximate the face component 20 and extends around the ribbon 350 from the heel side 12 of the face component 20 to the toe side 14 of the face component 20. The face component 20 in this embodiment comprises a pair of clip fixtures 22, 24, one on each of the heel and toe sides 12, 14 that receive protrusions 252, 254 extending from the ends of the weight ring 250. In other embodiments, the clip fixtures 22, 24 may be replaced with locking pin features, threaded screw features (as shown in FIG. 8), or other fastening mechanisms known to a person skilled in the art. The semicircular weight ring 250 moves weight towards the rear of the body 30, and thus adjusts the center of gravity location of the golf club head 10. The semicircular weight ring 250 also affects the bias of the golf club head 10, and affects the sound the golf club head 10 makes when it contacts a golf ball. The semicircular weight ring 250 may be made of multiple materials, with one side heavier than the other, and can be replaced with other weight rings 250 having different material compositions to adjust the center of gravity location and other mass properties of the golf club head 10. Each semicircular weight ring 250 provided for use with the golf club head 10 comprises at least one threaded through bore 256 oriented on the weight ring 250 so that it will line up with one of the threaded bores 214 provided on the elongated protrusion 210 on the cartridge 200.

As shown in FIG. 5, the preferred embodiment is assembled by placing the desired number of weight plugs 100 into the bores 205 of the cartridge 200 in the desired orientation, placing the cartridge 200 within the tube 45 in the desired orientation, and then selecting a semicircular weight ring 250 having the desired material composition, affixing the protrusions 252, 254 within the clip fixtures 22, 24, and then threading a screw fastener through the threaded through bore 256 of the semicircular weight ring 250 into one of the threaded bores 214 of the cartridge 200. In this way, each of the parts described herein is reversibly fixed together.

In an alternative embodiment, the golf club head 10 shown in FIG. 5 has an edge portion 35 instead of a ribbon 350, and does not include a ledge as shown in that Figure. Instead, the semicircular weight ring 250 is formed so that it is flush with the edge portion 35, such that the golf club head 10 looks similar to the embodiment shown in FIG. 2, but includes most of the features of the embodiment shown in FIG. 5.

In each of the embodiments shown in FIGS. 1-6, changing the orientation of the cartridge 50, 200 within the tube 45 changes the location of the golf club head's center of gravity along a vertical Z axis, and placing the at least one weight plug 100 within at least one of the plurality of bores 54, 205 changes the location of the golf club head's 10 center of gravity along at least one of the vertical Z axis, a horizontal Y axis that extends perpendicular with the vertical Z axis and parallel with the face, or a horizontal X axis that extends perpendicular to the face.

Figure 7:
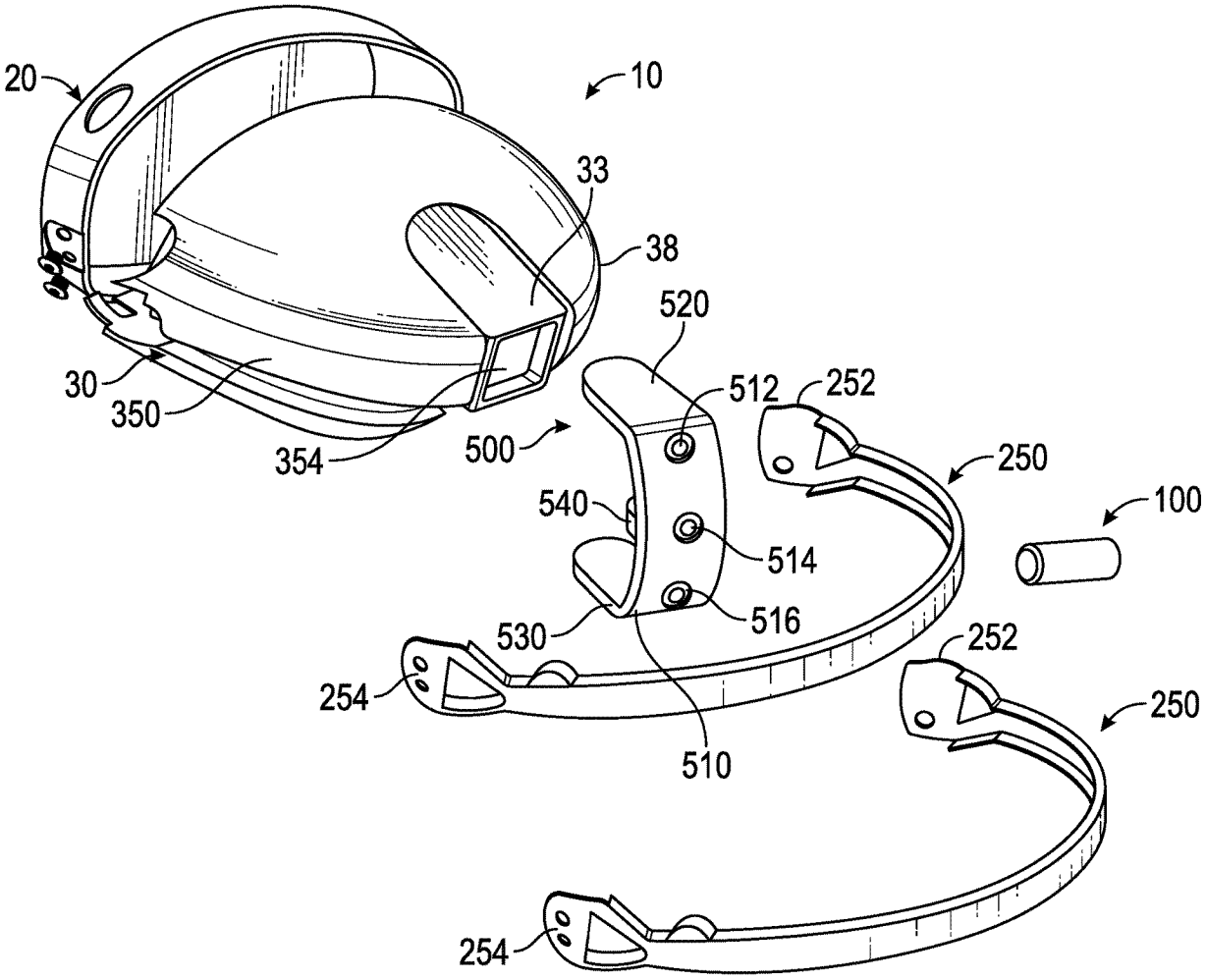
FIG. 7 is an exploded view of a third embodiment of the golf club head according to the present invention.
Figure 9:
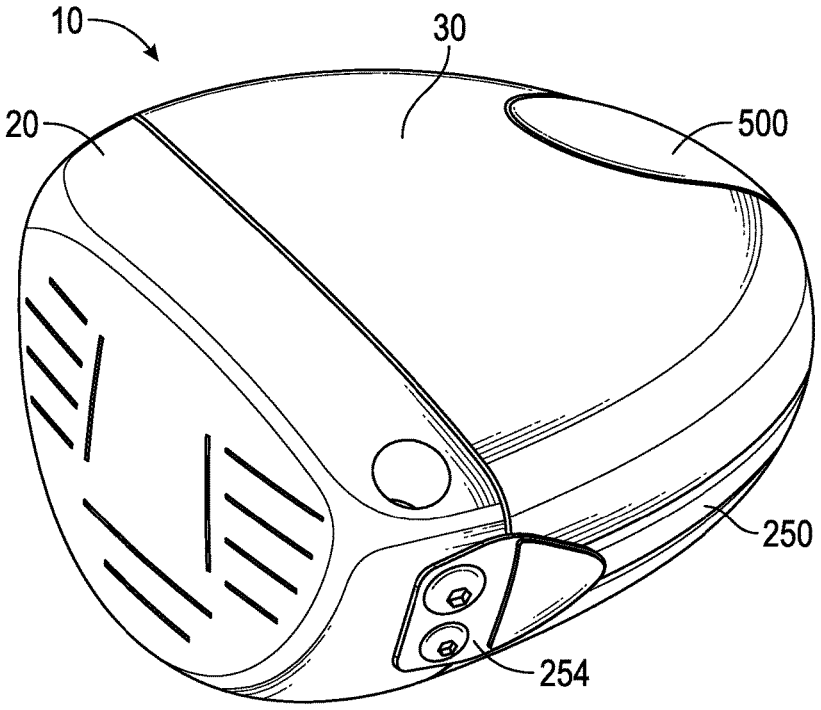
FIG. 9 is an assembled view of the embodiment shown in FIG. 8.
Figure 10A:
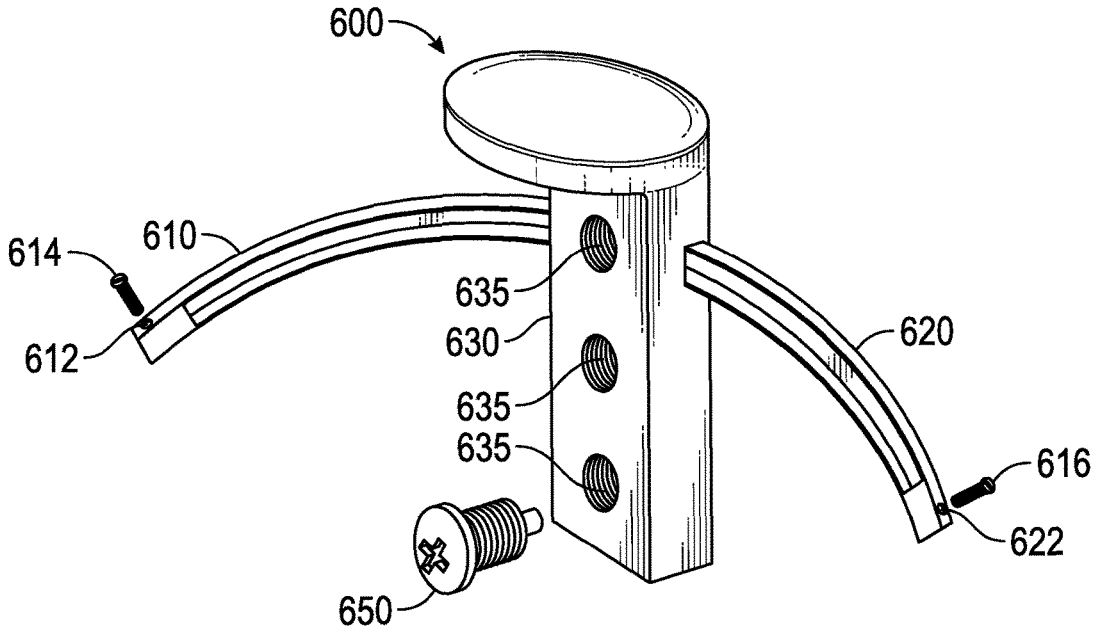
FIGS. 10A-10C are exploded views of a fourth embodiment of the golf club head according to the present invention.
Figure 10B:
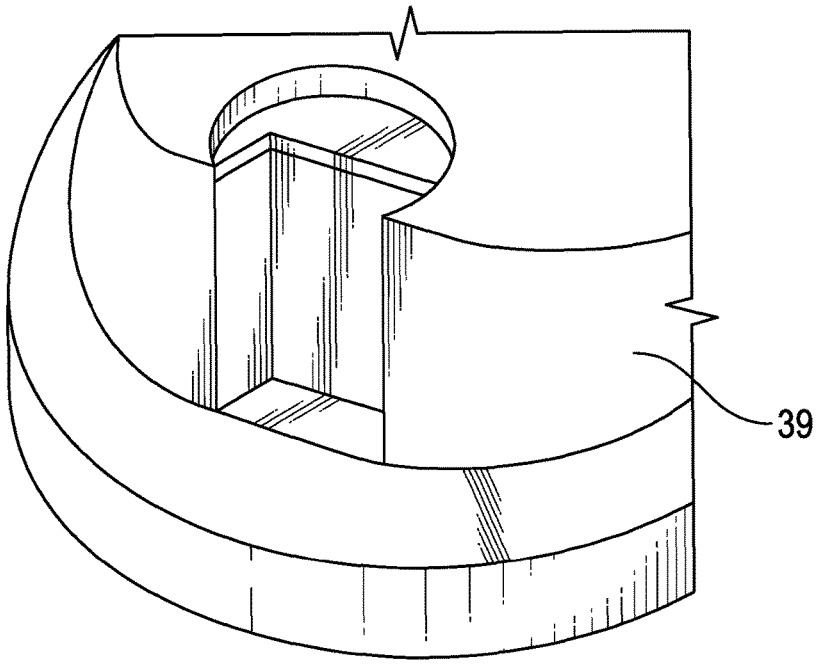
Figure 10C:
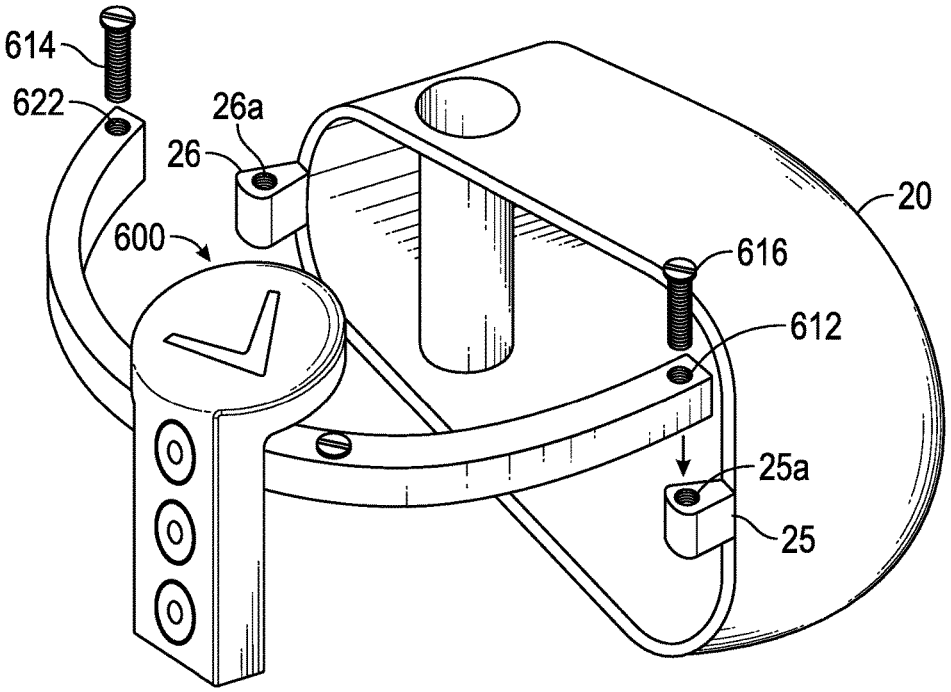

A third embodiment of the present invention is shown in FIGS. 7-9. This embodiment is similar to the one disclosed in FIGS. 5 and 6, in that the golf club head 10 comprises a face component 20 that is a metal alloy face cup and a body 30 composed of composite material, but does not include a tube 45. Furthermore, the weight cartridge 50, 200 is replaced with a weight cap 500 that is not entirely disposed within the golf club head 10, but instead wraps around the back edge 38 of the body 30 so that it contacts and overlaps at least part of the sole 32 and the crown 34. The weight cap 500 comprises a backbone portion 510, an upper protrusion 520 that fits over a portion of the crown 34, a lower protrusion 530 that fits over a portion of the sole 32, and a middle protrusion 540 that extends into a depression 354 formed in the ribbon 350 or, in an alternative embodiment, into a hole that communicates with the interior cavity of the body 30. In this embodiment, the crown 34 and sole 32 preferably include depressions 33 that receive the upper and lower protrusions 520, 530 so that these parts of the weight cap 500 are flush with the rest of the body 30 when the weight cap 500 is affixed to the body 30 as shown in FIG. 9, and thus are more aesthetically pleasing to a golfer.

The backbone portion 510 comprises three bores 512, 514, 516. The first bore 512 extends through the backbone portion 510 into the upper protrusion, the second bore 514 extends through the backbone portion 510 into the middle protrusion 540, and the third bore 516 extends through the backbone portion 510 into the lower protrusion 530. The bores 512, 514, 516 are sized to receive weight plugs 100, which may have any of the characteristics described with reference to other weight plugs 100 disclosed herein. The mass distribution of the weight cap 500 can be adjusted by placing one or more weight plugs 100 in the bores 512, 514, 516 or by inverting the orientation of the weight cap 500 on the body 30. In this embodiment, the weight cap 500 may, like the weight cartridges 50, 200 disclosed herein, have one or more heavy sides and one or more light sides formed from high density and low density materials, respectively, the orientation which can be changed by inverting the orientation of the weight cap 500 on the body 30.

The ribbon 350 or edge portion 35 of the body 30 also includes an elongated depression 356 sized to receive one of the semicircular weight rings 250 described herein, such that the semicircular weight ring 250 will be flush with the other surfaces of the body 30 when it is affixed to the golf club head 10 as shown in FIG. 9. The protrusions 252, 254 extending from the ends of the semicircular weight ring 250 shown in FIGS. 7-9 have through bores in them sized to receive one or more screws, which affix the protrusions to the face component 20 when the semicircular weight ring 250 is disposed within the elongated depression 356. As shown in each of these Figures, affixing the semicircular weight ring 250 to the golf club head presses against and traps the weight cap 500 on the body 30 and thus removably fixes it to the body 30 while the golf club head is in use. In another embodiment, the semicircular weight ring 250 may further trap the weight cap 500 by including a threaded through bore that extends through the semicircular weight ring 250 and lines up with a threaded bore in the backbone portion 510 of the weight cap 500, similar to the configuration shown in FIG. 5.

In a fourth embodiment, shown in FIGS. 10A, 10B, 10C, and 11, the semicircular weight ring described herein is combined with the weight cartridge, either by integrally forming the pieces or permanently affixing them to one another, to form a ring fixture 600 that, like the semicircular weight ring 250 disclosed herein, is removably affixed to the golf club head 10 by any means disclosed herein or known to a person of skill in the art. The ring fixture 600 includes first and second arms 610, 620 that extend away from a cartridge piece 630, which comprises a plurality of bores 635 sized to receive one or more weight inserts, which may be any of the weight plugs 100 disclosed herein and/or weight screws 650. If weight screws 650 are used, the bores 635 preferably have internal threads sized to mate with the threads of the weight screws 650.

Figure 11:
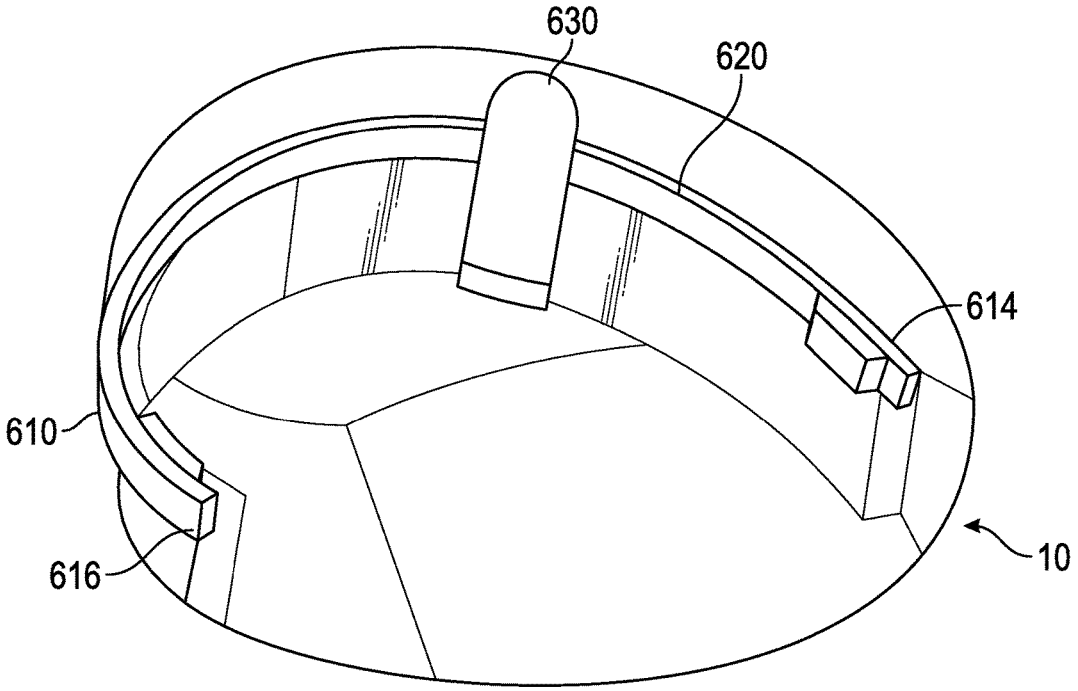
FIG. 11 is a transparent, perspective view of the golf club head shown in FIGS. 10A-10C.

The arms 610, 620 of the ring fixture 600 include bores 612, 622 at their ends, which receive threaded screws 614, 616 that thread through the bores 612, 622 and engage with threaded bores 25*a*, 26*a* in protrusions 25, 26 extending from the heel and toe sides of the face component 20. In this embodiment, the golf club head 10 preferably comprises a metal alloy face cup component 20 and a composite body 30 having a depression 39 that is sized to receive the ring fixture 600 so that the ring fixture 600 does not protrude from the golf club head 10 in an unsightly way. As shown in FIG. 11, the arms 610, 620 and cartridge piece 630 of the ring fixture 600 nest securely within the depression 39 so that the exterior surface of the golf club head 10 is smooth, and are fixed in place with the threaded screws 614, 616.

Figure 12A:
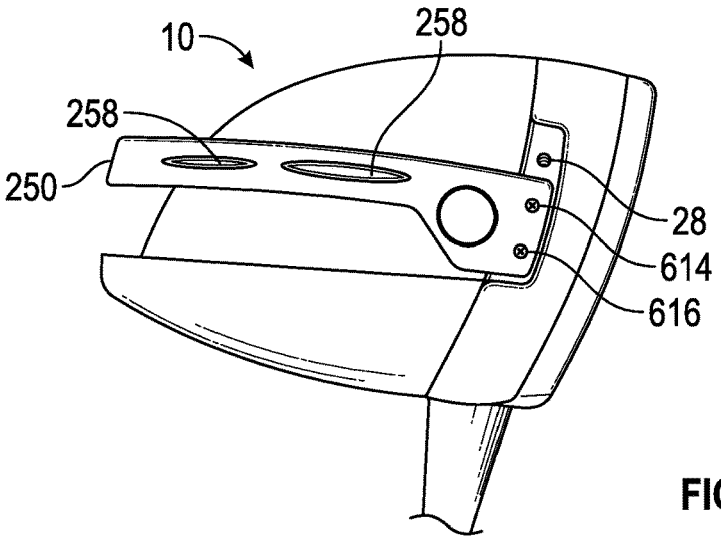
FIGS. 12A-12C are side perspective views of a fifth embodiment of the golf club head according to the present invention with a semicircular weight ring affixed in different configurations thereto.
Figure 12B:
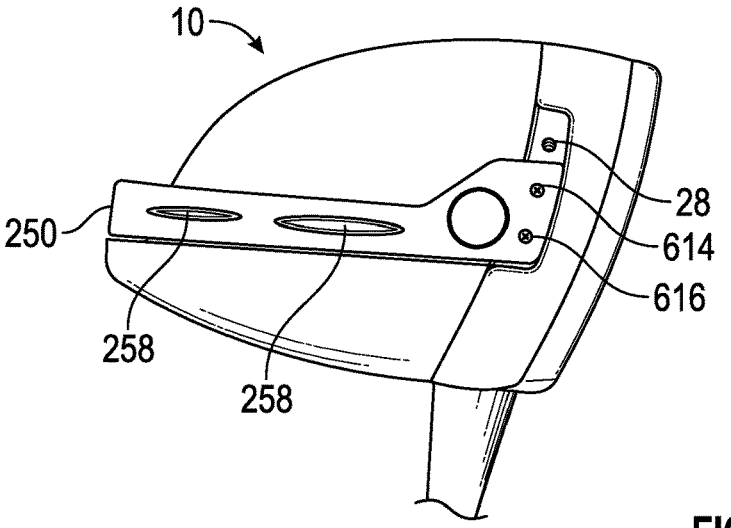
Figure 12C:
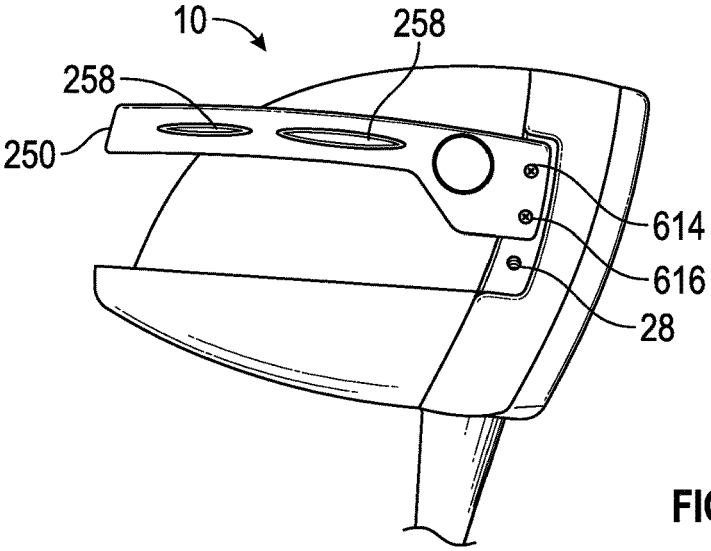

In a fifth embodiment, shown in FIGS. 12A, 12B, 12C, the golf club head 10 of the present invention does not include a weight cartridge 50, 200 or cartridge piece 630 as disclosed in connection with the other embodiments herein, but instead is configured to receive a semicircular weight ring 250, which may be selected from any of the semicircular weight rings 250 disclosed herein. As shown in FIG. 12A, the golf club head 10, which may be composed of any number of materials, but preferably comprises a composite body 30 and a metal alloy face component 20, is engaged with a semicircular weight ring 250 that is oriented such that the bulk of its mass, and the center of gravity of the golf club head 10, is located approximately midway between the crown 34 and the sole 32. In FIG. 12B, the semicircular weight ring 250 is oriented such that the bulk of its mass is located closer to the crown 34 so that the center of gravity is raised within the golf club head 10, and in FIG. 12C, the semicircular weight ring 250 is oriented such that the bulk of its mass is closer to the sole 32 so that the center of gravity is lowered within the golf club head 10.

As shown in these Figures, the face component 20 comprises a plurality of threaded bores 28 on its heel and toe sides 12, 14 that receive screws 614, 616, which extend through through-bores in the ends of each of the semicircular weight rings 250 to allow a golfer to removably fix them to the face component 20. In this embodiment, a single semicircular weight ring 250 can be used, and its orientation can be altered as shown in FIGS. 12A, 12B, 12C to achieve the center of gravity locations described herein. The semicircular weight ring 250 shown in connection with this embodiment also includes a plurality of openings 258 along its length, which may receive decorative medallions or weighted inserts to further adjust the mass properties of the golf club head 10.

Figure 13A:
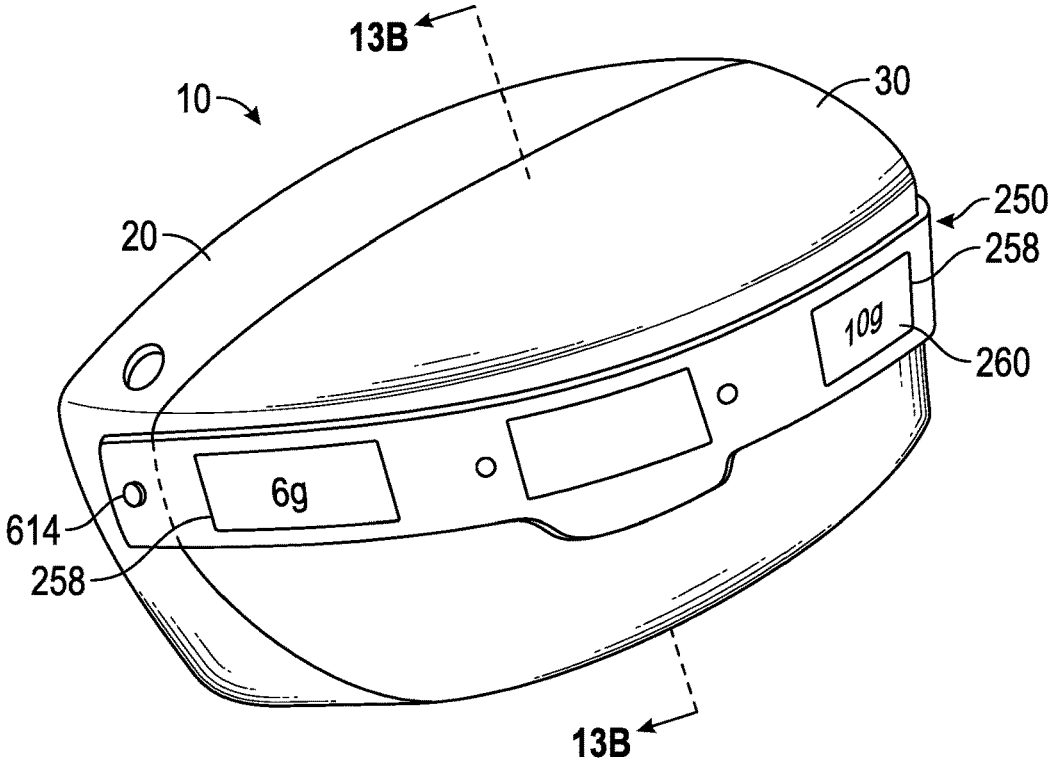
FIG. 13A is a rear perspective view of a seventh embodiment of the golf club head according to the present invention.
Figure 13B:
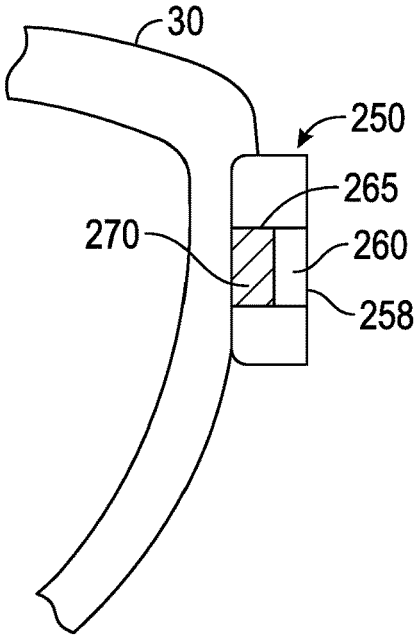
FIG. 13B is a cross-sectional view of the embodiment shown in FIG. 13A along lines 13B-13B.

In a further embodiment, shown in FIGS. 13A and 13B, the openings 258 extend through the semicircular weight ring 250 and include transparent or translucent windows 260 disposed flush with the external surface of the semicircular weight ring 250. The remaining empty space within the openings 258 functions as a pocket 265 that receives one or more removable weight inserts 270, which may have any of the features and/or material compositions disclosed in connection with the weight plugs 100 and other weighting devices disclosed herein. These removable weight inserts 270 preferably include markings, distinctive color patterns, and/or texturing that provide information about the mass characteristics of the weight inserts 270. This window 260/pocket 265/weight insert 270 configuration can be used with any of the semicircular weight rings 250 disclosed herein.

Figure 14:
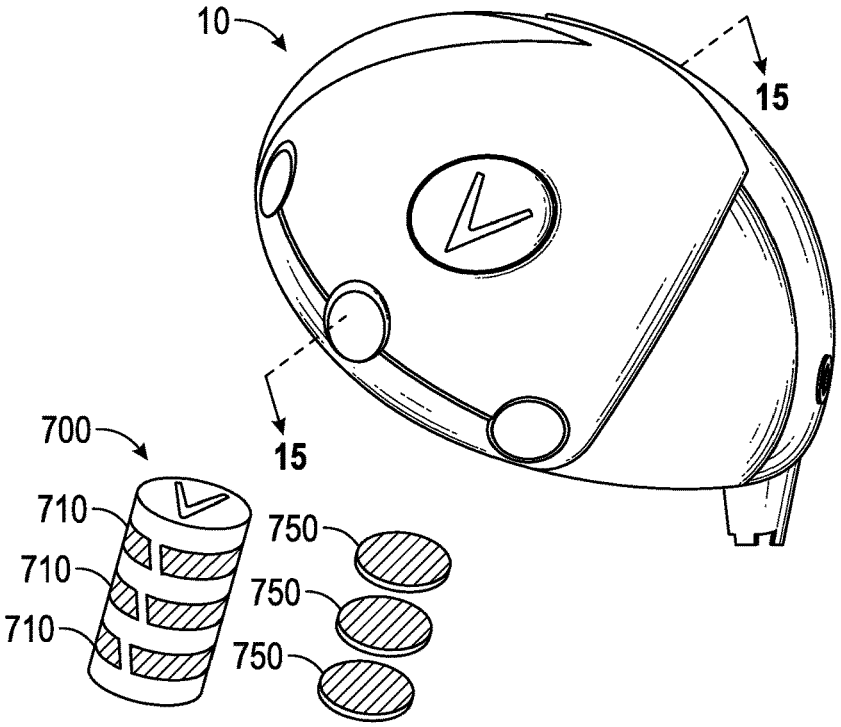
FIG. 14 is an exploded view of an eighth embodiment of the golf club head according to the present invention.
Figure 15:
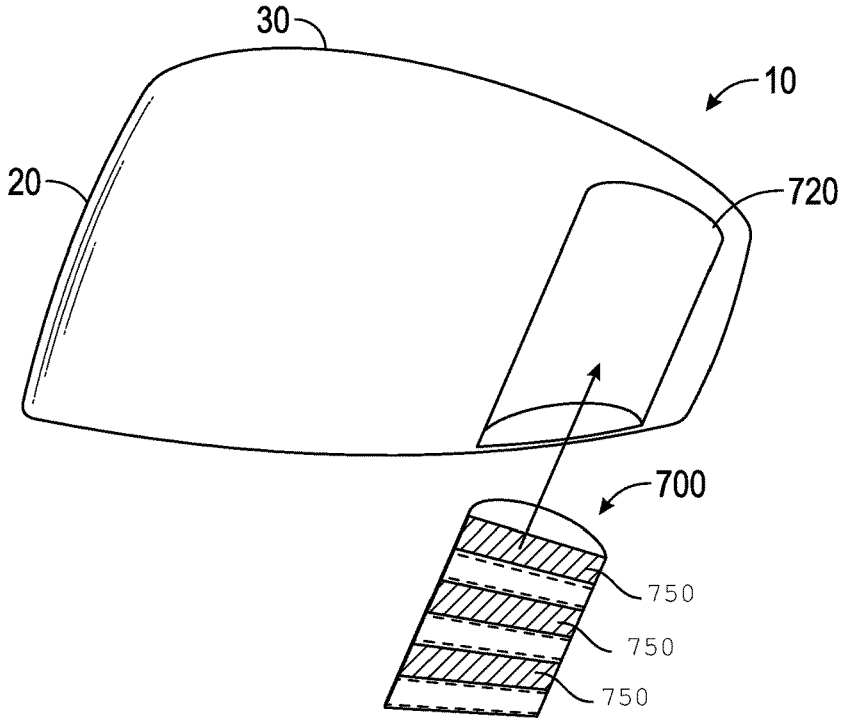
FIG. 15 is a cross-sectional view of the golf club head shown in FIG. 14.

The embodiments shown in FIGS. 12A-12C and 13A-B all relate to a golf club head 10 having a semicircular weight ring 250 without a cartridge. In an alternative embodiment, shown in FIGS. 14 and 15, the golf club head of the present invention includes a cartridge 700 but no semicircular weight ring 250. This embodiment is similar to the embodiment shown in FIG. 4, except that the cartridge 700, which may have the same material composition as any of the other cartridges 50, 200 disclosed herein, is completely cylindrical, fits within a tube 720 disposed at a rear side of the body 30, and includes flat, disc-shaped openings 710 sized to receive disc-shaped weight inserts 750. Each weight insert 750 is sized to fit within any of the openings 710, and can be assorted within the cartridge 700 to affect the location of the golf club head center of gravity along a vertical Z axis. The disc-shaped openings 710 and weight inserts 750 can be incorporated into any of the other cartridges 50, 200 disclosed herein.

Each of U.S. Pat. Nos. 7,147,573, 7,163,470, 7,252,600, 7,258,626, 7,258,631, 7,273,419, and 8,262,506 is hereby incorporated by reference in its entirety herein.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club head comprising:

a face component;

a body comprising a crown, a sole, an interior cavity, an edge portion where the crown transitions to the sole, and a rear portion opposite the face component; and at least one semicircular weight ring, wherein the at least one semicircular weight ring extends along the edge portion from a heel side of the face component to a toe side of the face component via the rear portion, wherein the at least one semicircular weight ring is removably affixed to the face component with at least one fastener, wherein the at least one semicircular weight ring affects the bias of the golf club head when it is affixed to the golf club head, wherein the body is formed separately from the face component, and wherein the head is a wood-type head.

2. The golf club head of claim 1, further comprising a weight insert, wherein the at least one semicircular weight ring comprises at least one pocket sized to receive the weight insert, and wherein the at least one pocket faces the body when the at least one semicircular weight ring is affixed to the golf club head.

3. The golf club head of claim 2, wherein at least one pocket comprises a window so that the weight insert is visible to a user when it is engaged with the pocket.

4. The golf club head of claim 3, wherein the window is filled with a translucent material.

5. The golf club head of claim 3, wherein the weight insert comprises texturing.

6. The golf club head of claim 1, wherein the edge portion comprises an elongated depression sized to receive the at least one semicircular weight ring.

7. The golf club head of claim 1, wherein the face component is a metal face cup.

8. The golf club head of claim 1, wherein the body is composed of a composite material.

* * * * *